US011413681B2

(12) United States Patent
Matsuura et al.

(10) Patent No.: US 11,413,681 B2
(45) Date of Patent: Aug. 16, 2022

(54) DIE CASTING METHOD AND DIE CASTING DEVICE

(71) Applicant: TOYOTA JIDOSHA KABUSHIKI KAISHA, Toyota (JP)

(72) Inventors: Yoshiki Matsuura, Toyota (JP); Junji Asano, Kariya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/137,977

(22) Filed: Dec. 30, 2020

(65) Prior Publication Data

US 2021/0268577 A1 Sep. 2, 2021

(30) Foreign Application Priority Data

Feb. 27, 2020 (JP) ..... JP2020-031294

(51) Int. Cl.

| | |
|---|---|
| ***B22D 17/04*** | (2006.01) |
| ***B22D 17/30*** | (2006.01) |
| ***B22D 17/32*** | (2006.01) |
| ***B22D 17/10*** | (2006.01) |
| ***B22D 17/20*** | (2006.01) |

(52) U.S. Cl.

CPC ..... *B22D 17/04* (2013.01); *B22D 17/10* (2013.01); *B22D 17/203* (2013.01); *B22D 17/30* (2013.01); *B22D 17/32* (2013.01)

(58) Field of Classification Search

CPC ..... B22D 17/08–12; B22D 17/2015; B22D 17/2046; B22D 17/2069; B22D 17/30; B22D 17/32

See application file for complete search history.

(56) References Cited

U.S. PATENT DOCUMENTS

| | | | | |
|---|---|---|---|---|
| 3,964,537 | A | 6/1976 | Koch et al. | |
| 5,289,388 | A * | 2/1994 | Dahroug | B22D 17/32 700/281 |
| 5,662,159 | A * | 9/1997 | Iwamoto | B22D 17/32 164/113 |
| 8,104,528 | B2 * | 1/2012 | Tsuchiya | B22D 17/20 164/61 |
| 2009/0194246 | A1 | 8/2009 | Tsuchiya et al. | |
| 2020/0108439 | A1 * | 4/2020 | Fujikawa | B22D 27/003 |

FOREIGN PATENT DOCUMENTS

| | | | |
|---|---|---|---|
| JP | 2008-93712 | A | 4/2008 |
| JP | 2009-226449 | A | 10/2009 |
| JP | 5121242 | B2 | 1/2013 |
| JP | 2018-176192 | A | 11/2018 |

* cited by examiner

*Primary Examiner* — Kevin E Yoon
*Assistant Examiner* — Jacky Yuen
(74) *Attorney, Agent, or Firm* — Sughrue Mion, PLLC

(57) ABSTRACT

A die casting method includes a step of supplying molten metal to a plunger sleeve, and a step of advancing a plunger in the plunger sleeve, to inject the molten metal into dies. In the step of injecting the molten metal into the dies, the plunger is once retracted before being advanced, and the plunger is kept accelerated until the plunger reaches a target maximum speed when the plunger retracted is advanced.

8 Claims, 5 Drawing Sheets

DIE CASTING METHOD AND DIE CASTING DEVICE

CROSS-REFERENCE TO RELATED APPLICATION

This application claims priority to Japanese Patent Application No. 2020-031294 filed on Feb. 27, 2020, incorporated herein by reference in its entirety.

BACKGROUND

1. Technical Field

The disclosure relates to a die casting method and a die casting device.

2. Description of Related Art

In die casting, after molten metal is supplied to a cylindrical plunger sleeve, a plunger tip is advanced at a high speed in the plunger sleeve, so as to inject the molten metal into a cavity of dies, as disclosed in Japanese Unexamined Patent Application Publication No. 2018-176192 (JP 2018-176192 A).

SUMMARY

The inventor of this disclosure found a problem as follows, in relation to the die casting method and die casting device. In die casting as disclosed in JP 2018-176192 A, after molten metal is poured into the plunger sleeve, the plunger tip needs to be advanced at a low speed, so as to settle down waves at a surface of the molten metal, and prevent the molten metal from becoming turbulence and trapping air during injection.

Thus, the temperature of the molten metal in the plunger sleeve is reduced while the plunger tip is advanced, which may result in a problem, such as generation of a fractured chilled layer, or cold flakes, in a cast article produced. The cold flakes, which are casting defects, are generated when initially solidified pieces of molten metal formed on the inner surface of the plunger sleeve are fractured, peeled off, and mixed into the cast article as the plunger tip is advanced.

The disclosure provides die casting method and die casting device, which can curb temperature reduction of molten metal in a plunger sleeve.

A die casting method according to a first aspect of the disclosure includes: supplying molten metal to a plunger sleeve, and advancing a plunger in the plunger sleeve, to inject the molten metal into dies. When the molten metal is injected into the dies, the plunger is once retracted before being advanced, and the plunger is kept accelerated until the plunger reaches a target maximum speed when the plunger retracted is advanced.

In the die casting method according to the first aspect of the disclosure, the plunger is once retracted before it is advanced, instead of providing a low-speed section, so that molten metal is prevented from becoming turbulence and trapping air during injection. As a result, waves generated at a surface of molten metal due to pouring of the metal settle down; therefore, when the plunger thus retracted is advanced, the plunger can be kept accelerated until it reaches the target maximum speed. Consequently, it is possible to reduce the time required for the injection process, and curb temperature reduction of the molten metal in the plunger sleeve, while preventing air from being trapped.

In the first aspect, after the molten metal is supplied from a supply port provided in the plunger sleeve, the supply port may be closed before the plunger is advanced. With this arrangement, when the plunger is advanced, the molten metal is less likely or unlikely to overflow from the supply port of the plunger sleeve.

In the first aspect, when the plunger is advanced, the plunger may be kept accelerated until the plunger reaches the target maximum speed, at a maximum acceleration which a die casting device is able to exhibit. With this arrangement, reduction of the molten metal temperature can be further curbed.

In the first aspect, when the plunger is once retracted, the plunger may be hydraulically driven with a servo pump. With this arrangement, movement of the plunger can be controlled with high accuracy, and electric power consumption can be reduced.

A die casting device according to a second aspect of the disclosure includes a plunger sleeve configured to be supplied with molten metal via a supply port, dies that communicate with the plunger sleeve, a plunger configured to inject the molten metal supplied to the plunger sleeve, into the dies, and a controller configured to control operation of the plunger. When the plunger is advanced to inject the molten metal into the dies, the controller is configured to once retract the plunger before advancing the plunger, and keep the plunger accelerated until the plunger reaches a target maximum speed when the plunger retracted is advanced.

In the die casting device according to the second aspect of the disclosure, the plunger is once retracted before it is advanced, instead of providing the low-speed section, so that molten metal is prevented from becoming turbulence and trapping air during injection. Then, when the plunger thus retracted is advanced, the plunger is kept accelerated until it reaches the target maximum speed. Thus, it is possible to reduce the time required for the injection process, and curb temperature reduction of the molten metal in the plunger sleeve.

In the second aspect, the die casting device may further include a lid portion configured to open and close the supply port. With this arrangement, when the plunger is advanced, the supply port of the plunger sleeve can be closed with the lid portion, and the molten metal can be prevented from overflowing from the supply port.

In the second aspect, when the plunger is advanced, the controller may be configured to keep the plunger accelerated until the plunger reaches the target maximum speed, at a maximum acceleration which the die casting device is able to exhibit. With this arrangement, reduction of the molten metal temperature can be further curbed.

In the second embodiment, the die casting device may further include a servo pump configured to hydraulically drive the plunger, when the plunger is once retracted. With this arrangement, movement of the plunger can be controlled with high accuracy, and power consumption can be reduced.

According to this disclosure, the die casting method that can curb temperature reduction of molten metal in the plunger sleeve is provided.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

One specific embodiment of the disclosure will be described in detail with reference to the drawings. It is, however, to be understood that the disclosure is not limited to the following embodiment. Also, the following description and the drawings are simplified as needed, so as to make description clear.

First Embodiment

Overall Structure of Die Casting Device

Figure 1:
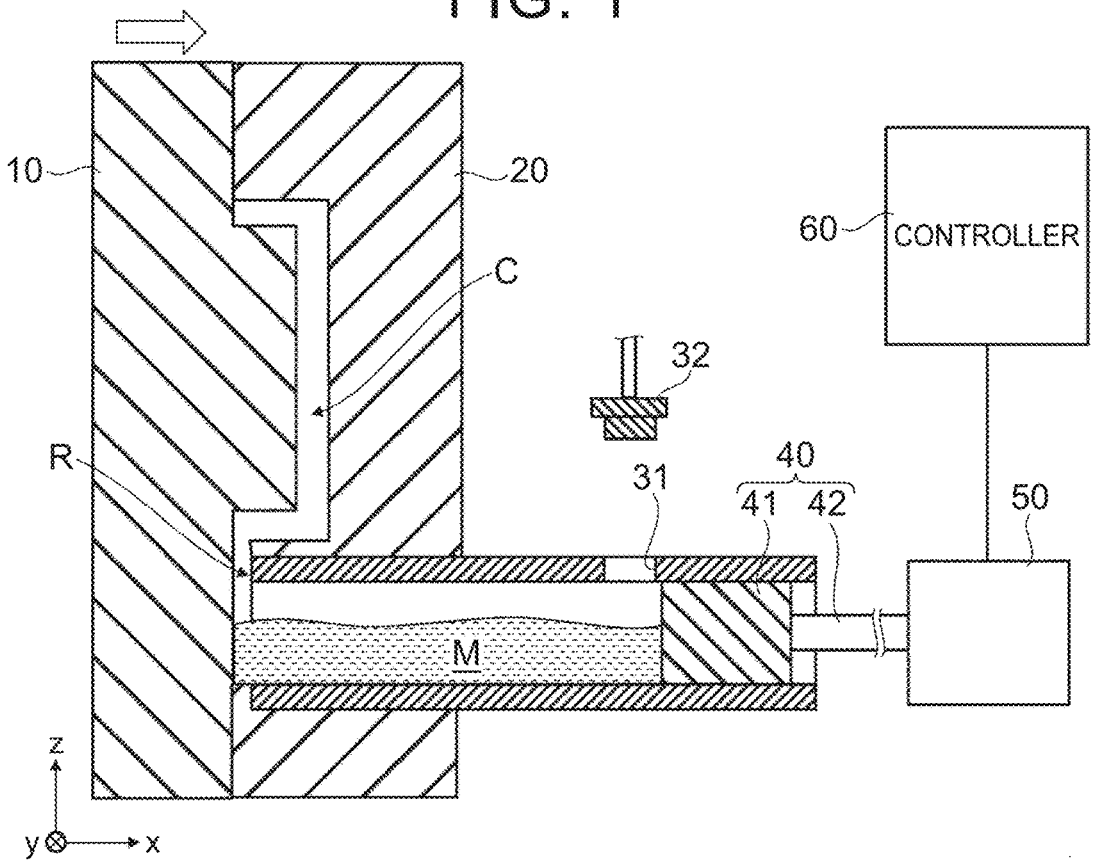
FIG. 1 is a schematic cross-sectional view of a die casting device.
Figure 2:
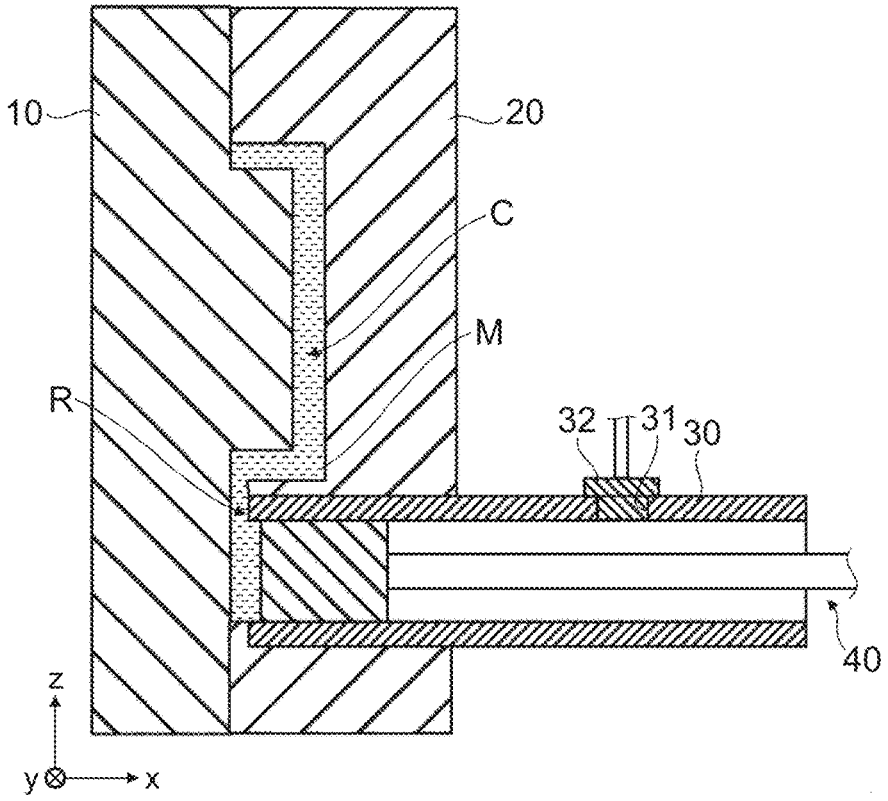
FIG. 2 is a schematic cross-sectional view of the die casting device.
Figure 3:
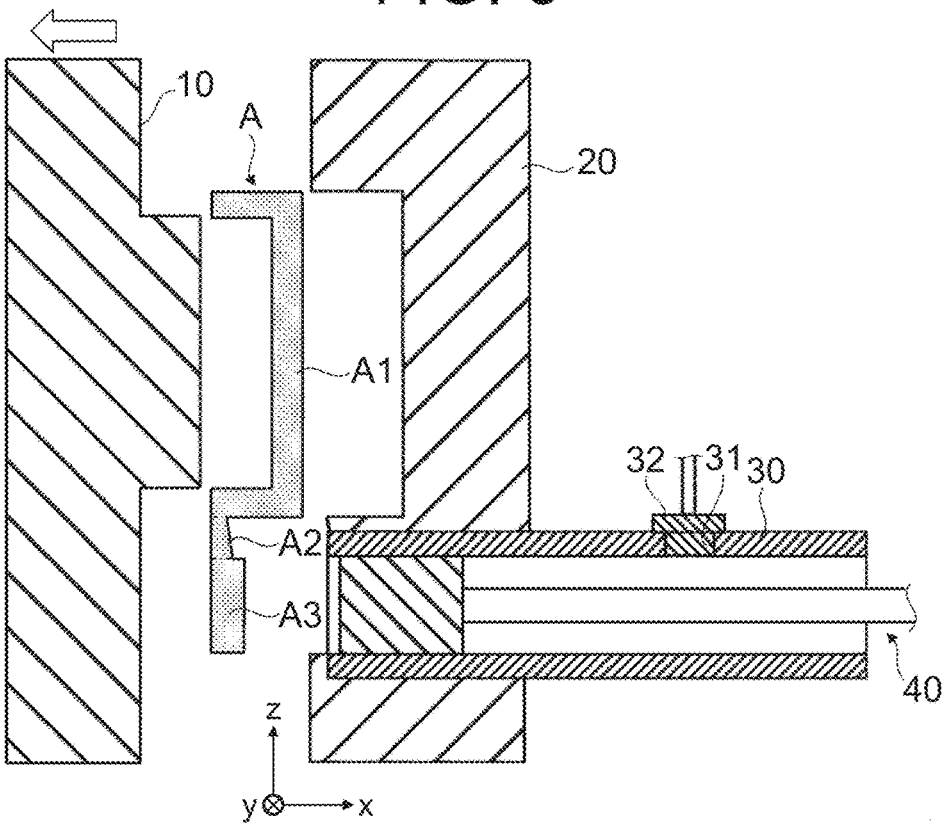
FIG. 3 is a schematic cross-sectional view of the die casting device.

Referring first to FIG. 1 to FIG. 3, the overall structure of a die casting device according to a first embodiment will be described. FIG. 1 to FIG. 3 are schematic cross-sectional views of the die casting device. As a matter of course, right-handed xyz orthogonal coordinates shown in FIG. 1 and other drawings are provided for descriptive purposes, namely, for describing the positional relationships among constituent elements. Normally, the positive direction of the z-axis is the vertical upward direction, and the xy plane is the horizontal plane, which are common to the drawings.

As shown in FIG. 1 to FIG. 3, the die casting device according to the first embodiment includes a movable die 10, fixed die 20, plunger sleeve 30, plunger 40, plunger drive source 50, and controller 60. Here, FIG. 1 to FIG. 3 illustrate operation of the die casting device. In FIG. 2 and FIG. 3, the plunger drive source 50 and the controller 60 are not illustrated.

FIG. 1 shows an operating state of the die casting device in which molten metal M is supplied to the plunger sleeve 30. FIG. 2 shows an operating state of the die casting device in which injection of the molten metal M into a cavity C is completed. FIG. 3 shows an operating state of the die casting device in which a cast article A is removed from dies (movable die 10, fixed die 20).

The movable die 10 is driven by a drive source (not shown), and is able to slide in the x-axis direction. On the other hand, the fixed die 20 is fixed to the die casting device. When the movable die 10 moves in the x-axis positive direction, and abuts against the fixed die 20, a cavity C that conforms with the shape of a product to be cast between the movable die 10 and the fixed die 20 is formed, as shown in FIG. 1.

As shown in FIG. 2, the cavity C is filled with the molten metal M, so that the cast article A as shown in FIG. 3 is produced. Then, the movable die 10 moves in the x-axis negative direction, to be separated from the fixed die 20, so that the cast article A can be taken out, as shown in FIG. 3. The movable die 10 and the fixed die 20 are formed of alloy tool steel for hot dies, for example. Each of the movable die 10 and fixed die 20 may have a nested structure.

As shown in FIG. 1, for example, the fixed die 20 is formed with a through-hole having a circular shape in cross section and a central axis parallel to the x-axis. The plunger sleeve 30 having a cylindrical shape is fitted in the through-hole. The plunger 40 slides inside the plunger sleeve 30 in the x-axis direction. A runner R that communicates with the plunger sleeve 30 and the cavity C and guides the molten metal M to the cavity C is formed between the fixed die 20 and the movable die 10, on the upper side of an end portion of the plunger sleeve 30 closer to the movable die 10 (or facing in the x-axis negative direction).

The plunger sleeve 30 is a cylindrical member having a central axis parallel to the x-axis. As described above, the plunger sleeve 30 is fitted in the through-hole of the fixed die 20. The molten metal M is poured into the plunger sleeve 30. The plunger sleeve 30 is formed of alloy tool steel for hot dies, for example.

A supply port 31 through which the molten metal M is poured into the plunger sleeve 30 is formed in the upper surface of the plunger sleeve 30 in the vicinity of its rear end portion (facing in the x-axis positive direction). For example, the molten metal M is poured from the supply port 31 into the plunger sleeve 30, using a ladle (not shown), for example. The method of feeding the molten metal is not limited to any method, but electromagnetic feeding or pneumatic feeding of molten metal, or the like, may be employed, in place of the feeding with the ladle.

Further, the plunger sleeve 30 is provided with a lid portion 32 that can open and close the supply port 31. When the plunger 40 ejects the molten metal M, the lid portion 32 can prevent the molten metal M from overflowing from the supply port 31. While the opening and closing actions of the lid portion 32 are not limited to any manner, the lid portion 32 can open and close the supply port 31, by moving in the z-axis direction by means of a drive source (not shown), in this embodiment. The opening and closing actions of the lid portion 32 are controlled by the controller 60, for example. In the example shown in FIG. 2 and FIG. 3, the lid portion 32 is fitted in the supply port 31. With the lid portion 32 thus fitted in the supply port 31, the bottom of the lid portion 32 is preferably flush with the inner circumferential surface of the plunger sleeve 30.

In the die casting device according to this embodiment, when the molten metal M is injected by the plunger 40, the plunger 40 is once retracted, and then advanced, as will be described later in detail. Thus, if the lid portion 32 is not provided, the molten metal M is likely to overflow from the supply port 31. Namely, the lid portion 32 can prevent the molten metal M from overflowing from the supply port 31. However, the lid portion 32 is not essential. If a sealed type electromagnetic feeding of molten metal, or the like, is employed, with the supply port 31 provided in a bottom portion of the plunger sleeve 30, for example, the lid portion 32 will not be needed.

The plunger 40 includes a plunger tip 41 and a plunger rod 42. The plunger tip 41 is a solid, cylindrical member that directly contacts the molten metal M in the plunger sleeve 30. The plunger tip 41 is connected to the plunger drive source 50, via the plunger rod 42 as a rod-like member having a central axis parallel to the x-axis, and can slide in the x-axis direction in the plunger sleeve 30. As shown in FIG. 2, when the plunger tip 41 slides from the rear end portion of the plunger sleeve 30 in the x-axis negative direction, the molten metal M poured into the plunger sleeve 30 is injected into the cavity C.

The plunger drive source 50 drives the plunger 40 in the x-axis direction. The plunger drive source 50 includes a hydraulic pump (so-called servo pump) driven by a servomotor, for example. The specific structure and operation of the plunger drive source 50 will be described in detail later. The plunger drive source 50 is not particularly limited, but may drive the plunger 40 only by use of a servomotor, without using any hydraulic pump, for example.

The controller 60 controls movements of the plunger 40. Namely, as shown in FIG. 1, the controller 60 controls the plunger drive source 50 that drives the plunger 40 in the x-axis direction. Further, the controller 60 may control any movement in the die casting device according to this embodiment, including movements of the movable die 10, and opening and closing actions of the lid portion 32, for example. In this case, the controller 60 may be divided into two or more sub-units.

Although not illustrated in the drawings, the controller 60 functions as a computer, and includes a computing unit, such as a central processing unit (CPU), and a storage unit, such as a random access memory (RAM) and a read-only memory (ROM), in which various control programs, data, etc. are stored.

Summary of Die Casting Method

Referring next to FIG. 1 to FIG. 3, operation of the die casting device according to the first embodiment, namely, the summary of the die casting method will be described. Initially, as shown in FIG. 1, the movable die 10 is brought into abutting contact with the fixed die 20, in a condition where the plunger tip 41 (i.e., the plunger 40) is retracted in the x-axis positive direction within the plunger sleeve 30, so that the cavity C is formed. Then, the molten metal M is supplied from the supply port 31 of the plunger sleeve 30 into the plunger sleeve 30, using a ladle (not shown), for example.

Then, as shown in FIG. 2, after the supply port 31 is closed with the lid portion 32, the plunger tip 41 is advanced in the plunger sleeve 30, so that the molten metal M is injected into the cavity C via the runner R. Here, as the plunger tip 41 is advanced, the molten metal M is pushed, and the cavity C can be filled with the molten metal M. The injection process from FIG. 1 to FIG. 2 will be described in detail later.

Then, as shown in FIG. 3, after the molten metal M solidifies in the cavity C, the movable die 10 is separated from the fixed die 20, and the cast article A is taken out of the dies. As shown in FIG. 3, the cast article A has a runner portion A2 and a biscuit portion A3, in addition to a product portion A1. A one-dot chain line indicated in the cast article A in FIG. 3 is an expedient boundary line between the product portion A1, and the runner portion A2 and biscuit portion A3.

The runner portion A2 is a portion in which the molten metal M solidified in the runner R. The biscuit portion A3 is a portion in which the molten metal M surrounded by a front end face of the plunger tip 41 and the dies (movable die 10 and fixed die 20) solidified. The runner portion A2 and the biscuit portion A3 are eventually removed, and the product portion A1 is used as a product.

Details of Injection Process

Figure 4:
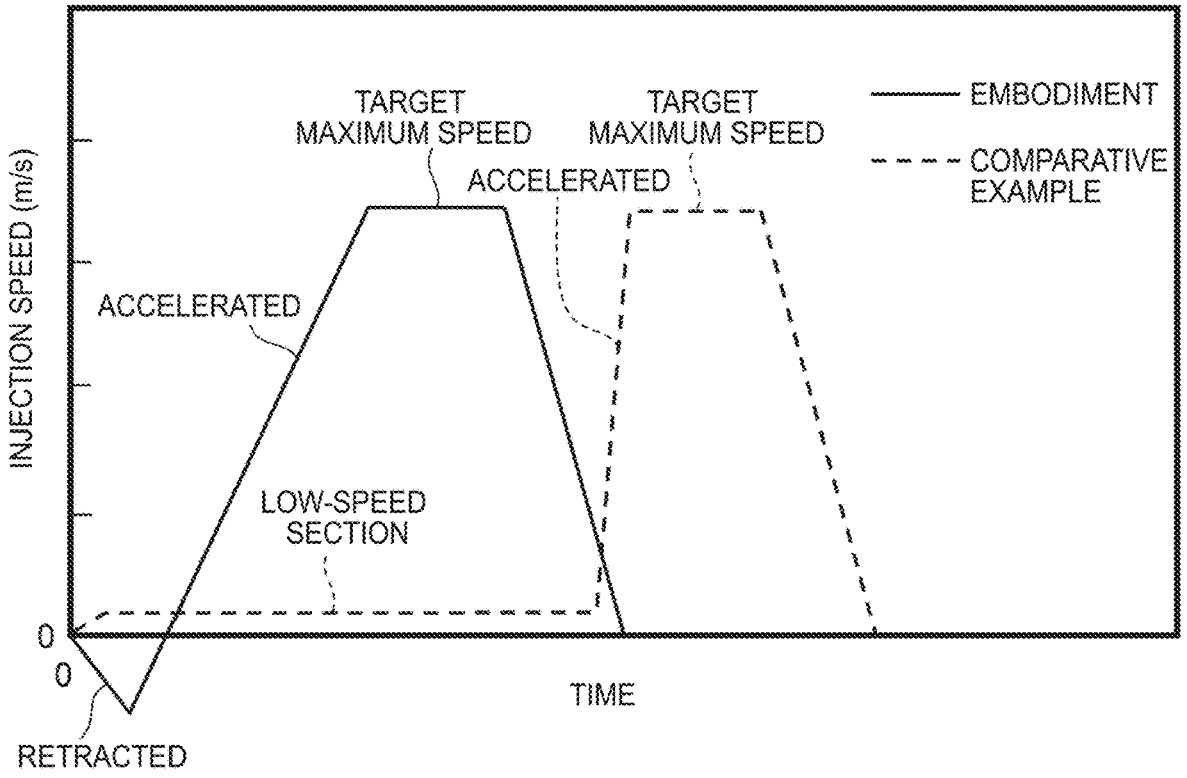
FIG. 4 is a graph indicating change of the injection speed in an injection process of a die casting method according to a first embodiment and that of a comparative example.

Referring next to FIG. 4, the injection process of the die casting method according to the first embodiment will be described in detail. FIG. 4 is a graph indicating change of the injection speed with time in the injection process of the die casting method according to the first embodiment and that of a comparative example. In FIG. 4, the horizontal axis indicates time, and the vertical axis indicates the injection speed, namely, the speed (m/s) of the plunger tip 41. The change of the injection speed in this embodiment is indicated by a solid line, and that of the comparative example is indicated by a broken line.

Initially, the injection process of the die casting method according to the comparative example indicated by the broken line in FIG. 4 will be described. In the injection process according to the comparative example, after the molten metal M is poured into the plunger sleeve 30, the plunger tip 41 is advanced at a constant low speed from the start of injection (a low-speed section in FIG. 4), so that waves at a surface of the molten metal M settle down, and air is prevented from being trapped in the molten metal M that would otherwise become turbulence when injected. The speed in the low-speed section is, for example, about 0.1 m/s to 0.5 m/s.

Then, the plunger tip 41 is kept accelerated until it reaches a target maximum speed at a given acceleration. The acceleration is suitably determined according to the product (for example, the cast article A in FIG. 3), but is preferably set to be as large as possible, for example, set to the largest acceleration that can be exhibited by the die casting device. Then, as the plunger tip 41 is kept advanced at the target maximum speed, the cavity C is filled with the molten metal M; as a result, the plunger tip 41 is not advanced any more, and stops. The target maximum speed is suitably set according to the product, and is about several m/s, for example.

In the comparative example, since the low-speed section is provided, a period of time for which the plunger tip 41 is advanced is long, namely, it takes a long time from pouring of the molten metal to completion of injection. Thus, the temperature of the molten metal M may be reduced in the plunger sleeve 30 after pouring of the metal, and a fractured chilled layer, or cold flakes, may be generated.

Next, the injection process of the die casting method according to this embodiment indicated by the solid line in FIG. 4 will be described. In the injection process according to this embodiment, after the molten metal M is poured into the plunger sleeve 30, the plunger tip 41 is once retracted before it is advanced. After the plunger tip 41 is retracted, its moving direction is immediately switched to the forward direction, and the plunger tip 41 is kept accelerated at a given acceleration, until it reaches a target maximum speed. The acceleration is suitably determined according to the product, but is preferably set to be as large as possible, for example, set to the largest acceleration that can be exhibited by the die casting device.

Then, as in the comparative example, as the plunger tip 41 is kept advanced at the target maximum speed, the cavity C is filled with the molten metal M; as a result, the plunger tip 41 is not advanced any more, and stops. Needless to say, the plunger tip 41 may be forced to be decelerated, so that the plunger tip 41 stops at a predetermined position.

As shown in FIG. 4, in the injection process according to the comparative example, the low-speed section is provided before the plunger tip 41 is accelerated, so as to prevent air from being trapped in the molten metal M that would otherwise become turbulence when it is injected. On the other hand, in the injection process according to this embodiment, the plunger tip 41 is once retracted before it is advanced, instead of providing the low-speed section.

In this manner, waves generated at the surface of the molten metal due to pouring settle down; therefore, when the retracted plunger tip 41 is advanced, the plunger tip 41 can be kept accelerated until it reaches the target maximum speed. Thus, in the injection process according to this embodiment, it is possible to reduce the time required for the injection process, as compared with the comparative example, while making air less likely or unlikely to be trapped in the molten metal M. Consequently, it is possible to curb temperature reduction of the molten metal M in the plunger sleeve 30, and curb generation of the cold flakes in the cast article A.

Also, since the time required for the injection process is short in the injection process according to this embodiment, the cycle time of die casting is shortened, and the production efficiency of cast articles A is improved, as compared with the comparative example. Further, as shown in FIG. 4, in this embodiment, the acceleration of the plunger tip 41 can be made smaller than that of the comparative example. Thus, the output power, size, and power consumption of the plunger drive source 50 can be reduced.

Figure 5:
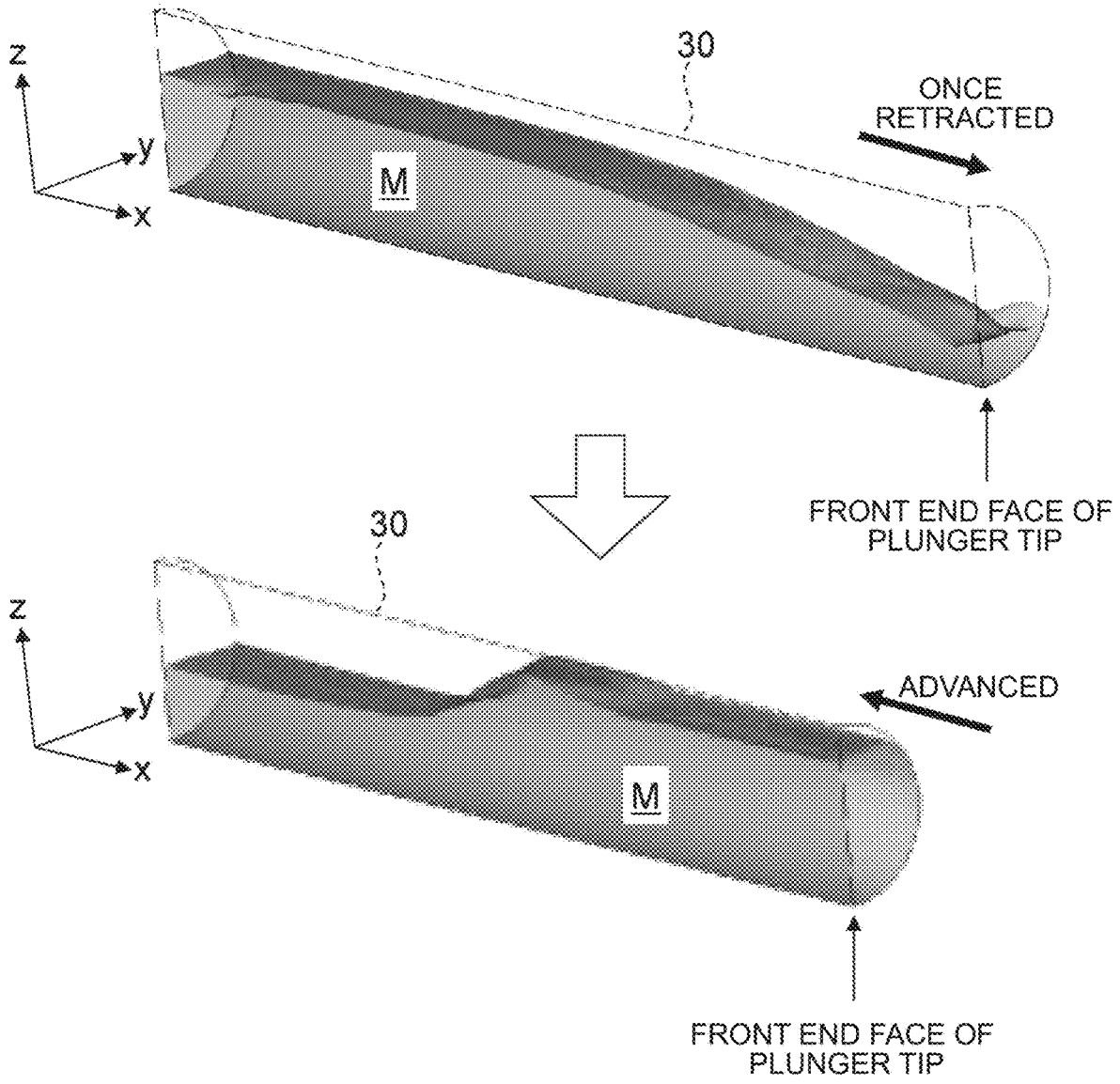
FIG. 5 is a perspective cross-sectional view of the inside of a plunger sleeve in the injection process according to the first embodiment.

Referring to FIG. 1 and FIG. 5, a mechanism that curbs trapping of air by once retracting the plunger tip 41 before advancing it will be described. FIG. 5 is a perspective cross-sectional view of the inside of the plunger sleeve 30 in the injection process according to the first embodiment. Initially, when the molten metal M is poured into the plunger sleeve 30, waves are generated at a surface of the molten metal, as shown in FIG. 1.

Then, when the plunger tip 41 is once retracted in the x-axis positive direction as shown in the upper section of FIG. 5, a large wave is generated so that the molten metal M as a whole moves backward (in the x-axis positive direction). As a result, the waves generated at the molten metal surface due to pouring settle down. The length of time and distance over which the plunger tip 41 is retracted may be suitably determined depending on the amount of the molten metal M, as long as the above phenomenon appears, but are preferably set to be as short as possible.

Then, when the plunger tip 41 is advanced in the x-axis negative direction, as shown in the lower section of FIG. 5, the molten metal M moves backward (in the x-axis positive direction), in a condition where the waves at the molten metal surface settle down, so that the filling rate of the molten metal M on the side closer to the front end face of the plunger tip 41 is raised. Here, the filling rate of the molten metal M is the proportion of the molten metal M to the interior space of the plunger sleeve 30.

Then, while the condition where the waves at the molten metal surface settle down, and the condition where the filling rate of the molten metal M on the side closer to the front end face of the plunger tip 41 is high, are maintained, the plunger tip 41 moves the molten metal M forward (in the x-axis negative direction). Thus, it is possible to inject the molten metal M while discharging air to the cavity C side, without trapping air.

As described above, in the injection process according to this embodiment, the plunger tip 41 is once retracted before being advanced, instead of providing the low-speed section, so that the molten metal M is prevented from becoming turbulence and trapping air during injection. As a result, the waves generated at the molten metal surface due to pouring settle down; therefore, when the plunger tip 41 once retracted is advanced, the plunger tip 41 can be kept accelerated until it reaches the target maximum speed.

Thus, it is possible to reduce the time required for the injection process, and curb temperature reduction of the molten metal M in the plunger sleeve 30, while preventing air from being trapped. Consequently, cold flakes are less likely or unlikely to be generated in the cast article A. Further, since the time required for the injection process is short, the cycle time of die casting is shortened, and the production efficiency of the cast articles A is improved.

Details of the Plunger Drive Source 50

Next, referring to FIG. 6 to FIG. 9, one example of the configuration and operation of the plunger drive source 50 will be described in detail. FIG. 6 to FIG. 9 are hydraulic circuit diagrams each showing details of one example of the configuration and operation of the plunger drive source 50.

As shown in FIG. 6 to FIG. 9, the plunger drive source 50 includes an injection cylinder 51, injection piston 52, accumulator ACC, hydraulic pump P, servomotor MT, oil tank OT, and valves V1 to V5. In FIG. 6 to FIG. 9, thick arrows indicate the flow of hydraulic oil. Also, "C" indicated along with the valves V1 to V5 indicates that the valve in question is closed, and "O" indicates that the valve is open. Operation of the servomotor MT and opening and closing of the valves V1 to V5 are controlled by the controller 60 shown in FIG. 1, for example.

Initially, referring to FIG. 6, the configuration of the plunger drive source 50 will be described. The interior of the injection cylinder 51 is filled with hydraulic oil, and the injection piston 52 slides in the longitudinal direction. When the hydraulic oil is introduced from a rear end portion of the injection cylinder 51, and discharged from its front end portion, the injection piston 52 is advanced. On the other hand, when the hydraulic oil is introduced from the front end portion of the injection cylinder 51, and discharged from the rear end portion, the injection piston 52 is retracted. The injection piston 52 is joined to the rear end of the plunger rod 42. As shown in FIG. 1 to FIG. 3, the plunger tip 41 is joined to the front end of the plunger rod 42.

Figure 6:
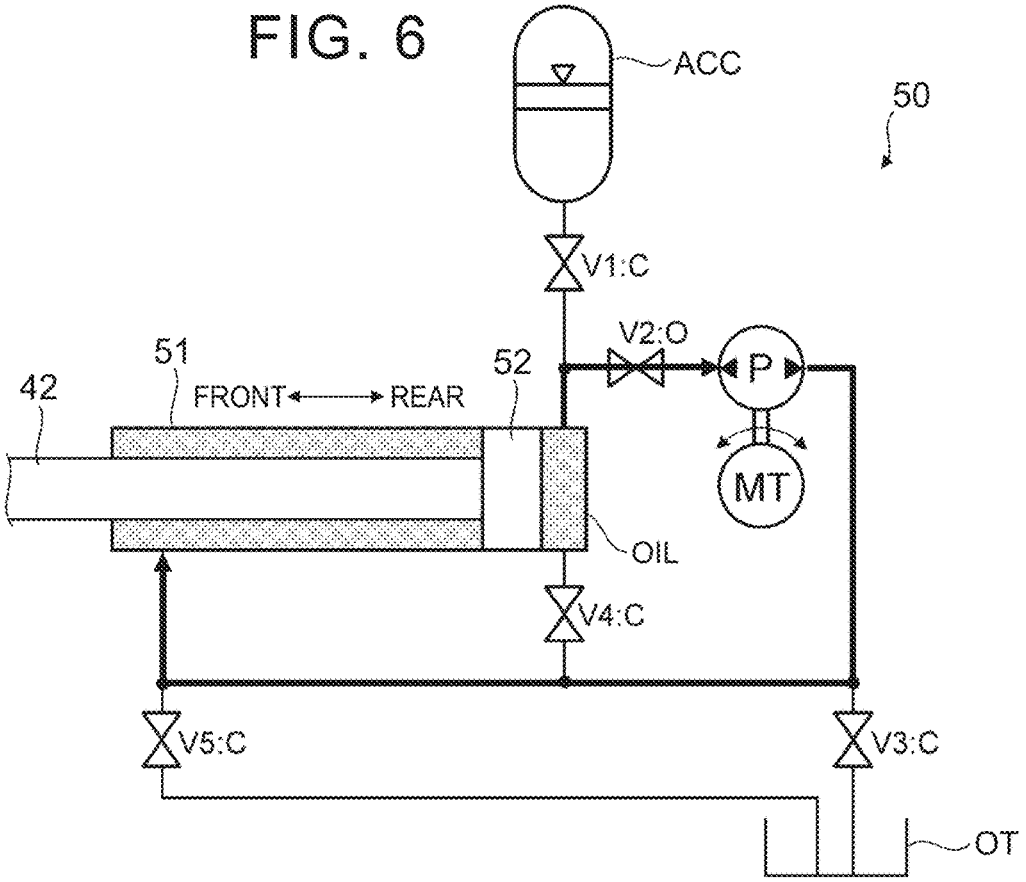
FIG. 6 is a hydraulic circuit diagram showing one example of the configuration and operation of a plunger drive source in detail.

As shown in FIG. 6, the accumulator ACC is connected to the rear end portion of the injection cylinder 51 via the valve V1. When the hydraulic oil stored in the accumulator ACC is introduced at a given pressure into the rear end portion of the injection cylinder 51, the injection piston 52 is advanced.

The hydraulic pump P is a bidirectional servo pump driven by the servomotor MT. One end of the hydraulic pump P is connected to the rear end portion of the injection cylinder 51 via the valve V2. The other end of the hydraulic pump P is connected to the front end portion of the injection cylinder 51, and is also connected to the oil tank OT via the valve V3. The rear end portion of the injection cylinder 51 is connected to the front end portion of the injection cylinder 51 via the valve V4, and is also connected to the oil tank OT via the valve V5.

Next, referring to FIG. 6 to FIG. 9, operation of the plunger drive source 50 will be described. FIG. 6 shows operation of the plunger drive source 50 when the plunger tip 41 is once retracted after pouring of molten metal. The operation corresponds to operation in a section labelled with "RETRACTED" on the graph indicated by the solid line in FIG. 4.

As shown in FIG. 6, the valve V2 is opened, and the valves V1, V3 to V5 other than the valve V2 are closed. When the hydraulic pump P operates to feed the hydraulic oil from the front end portion to the rear end portion of the injection cylinder 51, the injection piston 52 (i.e., the plunger tip 41) is retracted. Thus, in this embodiment, when the plunger tip 41 is once retracted, the plunger tip 41 is driven by the servo pump. Thus, the movement of the plunger tip 41 can be controlled with high accuracy, and the power consumption can be reduced.

Figure 7:
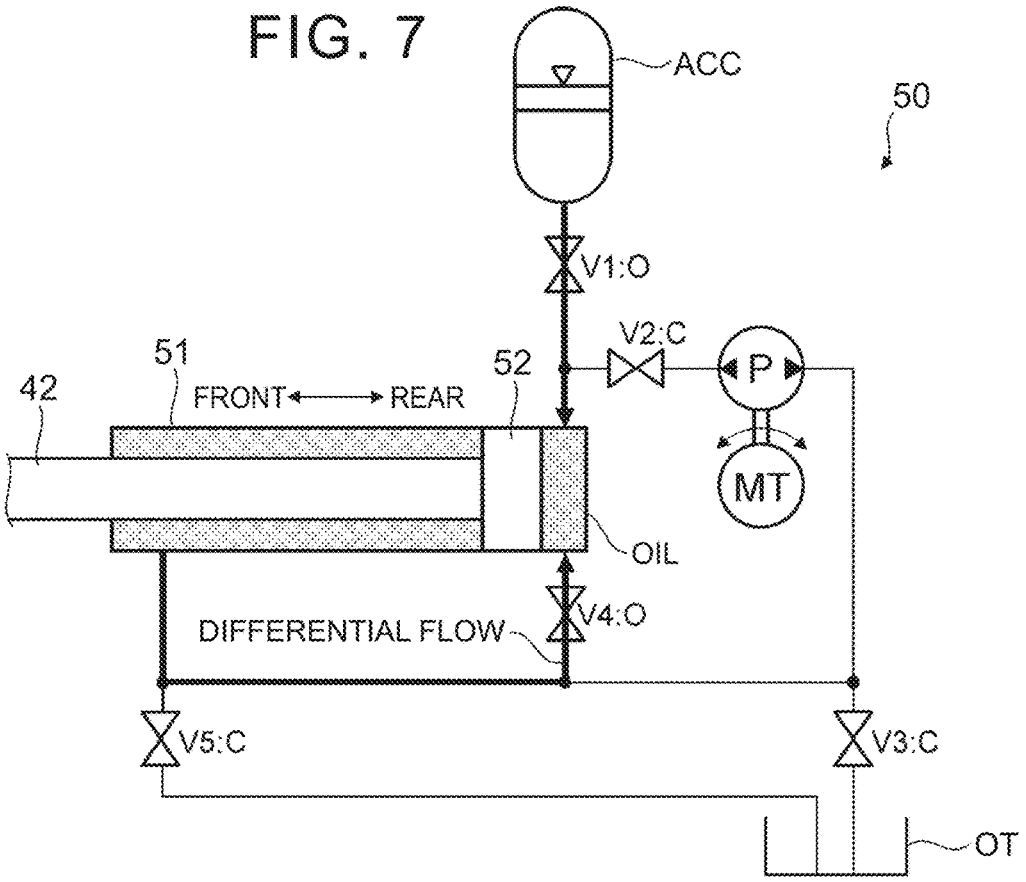
FIG. 7 is a hydraulic circuit diagram showing one example of the configuration and operation of the plunger drive source in detail.

Next, FIG. 7 shows operation of the plunger drive source 50 when the plunger tip 41 is advanced. The operation corresponds to operation in sections labelled with "ACCELERATED" and "TARGET MAXIMUM SPEED", on the graph indicated by the solid line in FIG. 4.

As shown in FIG. 7, the valve V2 is closed, and the valves V1, V4 are opened, from the state of FIG. 6. The hydraulic oil stored in the accumulator ACC is introduced into the rear end portion of the injection cylinder 51 via the valve V1, so that the injection piston 52 is advanced. At the same time, the hydraulic oil is fed from the front end portion to the rear end portion of the injection cylinder 51 via the valve V4. Owing to the differential flow of the hydraulic oil, the injection piston 52 is advanced at a higher speed, as compared with the case where the injection piston 52 is advanced only with the accumulator ACC.

When the plunger tip 41 once retracted is advanced, the hydraulic pump P may be rotated in the reverse direction in FIG. 6, so that the plunger tip 41 is advanced, and then, the plunger drive source 50 may proceed to the operation shown in FIG. 7. Since the hydraulic pump P is driven by the servomotor MT, the injection piston 52 can be quickly switched from the "RETRACTED" mode to the "ADVANCED" mode.

Figure 8:
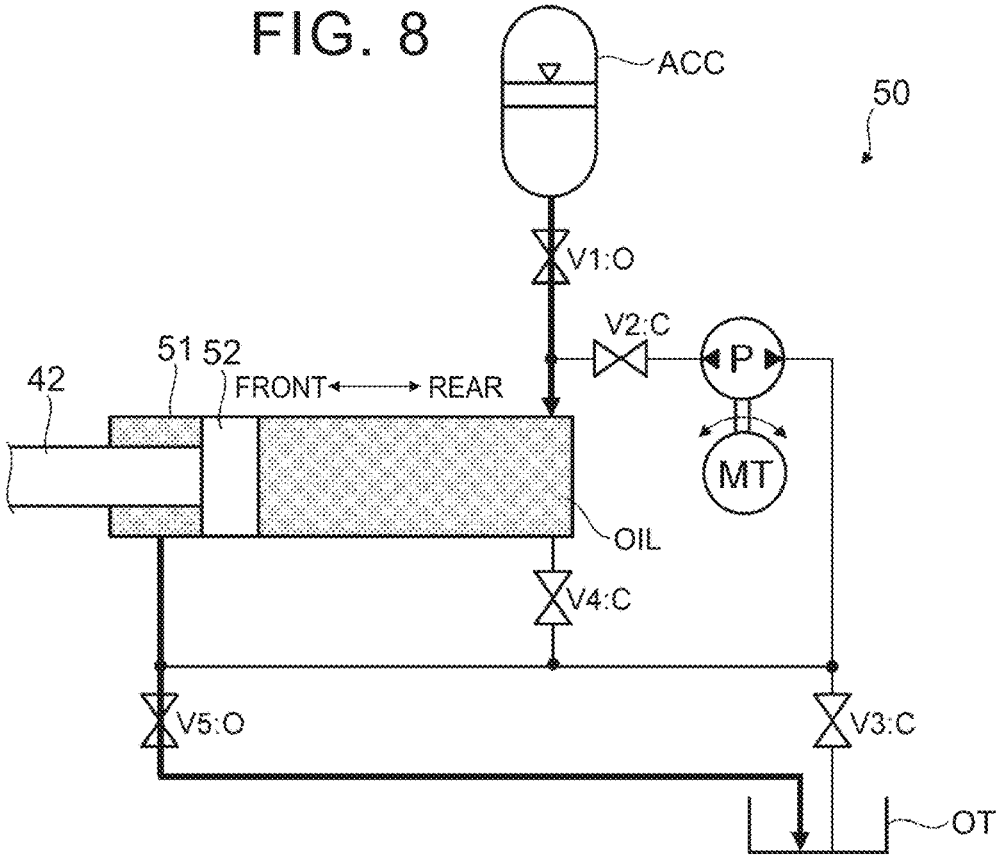
FIG. 8 is a hydraulic circuit diagram showing one example of the configuration and operation of the plunger drive source in detail.

FIG. 8 shows operation of the plunger drive source 50 when the molten metal M is further pressurized, in the state shown in FIG. 2, after the plunger tip 41 is stopped. The operation corresponds to operation in a section after the plunger tip 41 is decelerated and stopped, on the graph indicated by the solid line in FIG. 4.

As shown in FIG. 8, the valve V4 is closed, and the valve V5 is opened, from the state of FIG. 7. Namely, the differential flow of the hydraulic oil is shut off, and the injection piston 52 is pressed only with the accumulator ACC. The hydraulic oil pushed out from the front end portion of the injection cylinder 51 is discharged to the oil tank OT via the valve V5, and stored.

As described above, the injection piston 52 is advanced at a high speed, due to the differential flow of the hydraulic oil. Meanwhile, a pressure loss appears due to the differential flow of the hydraulic oil. Thus, it is possible to raise the pressure with which the injection piston 52 (i.e., the plunger tip 41) is pressed, by shutting off the differential flow of the hydraulic oil.

Figure 9:
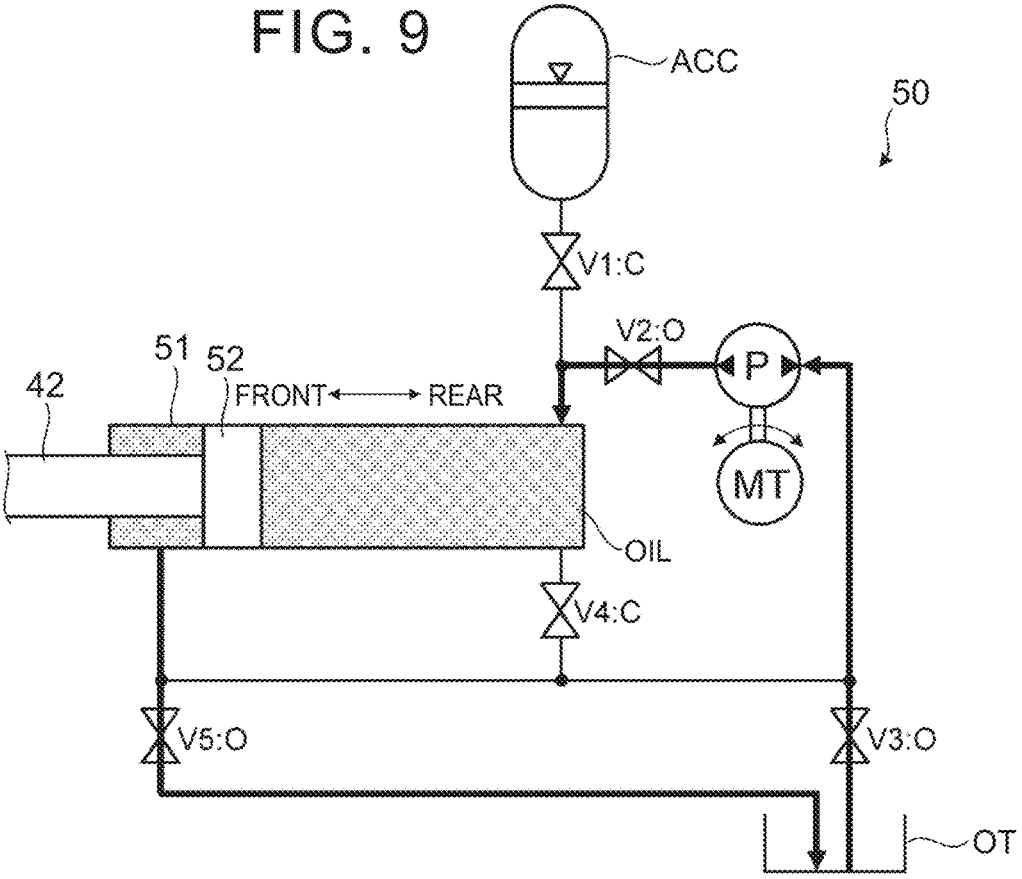
FIG. 9 is a hydraulic circuit diagram showing one example of the configuration and operation of the plunger drive source in detail.

FIG. 9 shows operation of the plunger drive source 50 when the pressure is to be further increased from the state shown in FIG. 8. As shown in FIG. 9, the valve V1 is closed, and the valves V2, V3 are opened, from the state of FIG. 8. Namely, the injection piston 52 is pressed with the hydraulic pump P, in place of the accumulator ACC.

More specifically, the hydraulic pump P sucks up the hydraulic oil from the oil tank OT, via the valve V3, and delivers the hydraulic oil to the rear end portion of the injection cylinder 51, via the valve V2. The hydraulic oil pushed out from the front end portion of the injection cylinder 51 is discharged to the oil tank OT via the valve V5, and stored. If the output of the hydraulic pump P is larger than that of the accumulator ACC, the pressure at which the injection piston 52 (i.e., the plunger tip 41) is pressed is further raised, as compared with that in the state of FIG. 8.

It is to be understood that the disclosure is not limited to the above embodiment, but the embodiment may be modified as needed, without departing from the principle of the disclosure.

What is claimed is:

1. A die casting method comprising:

supplying molten metal to a plunger sleeve;

after supplying the molten metal to the plunger sleeve, retracting a plunger once; and after the plunger is once retracted, advancing the plunger in the plunger sleeve, to inject the molten metal into dies, wherein, the plunger is kept accelerated until the plunger reaches a target maximum speed when the retracted plunger is advanced.

2. The die casting method according to claim 1, wherein, after the molten metal is supplied from a supply port provided in the plunger sleeve, the supply port is closed before the plunger is advanced.

3. The die casting method according to claim 1, wherein, when the plunger is advanced, the plunger is kept accelerated until the plunger reaches the target maximum speed, at a maximum acceleration which a die casting device is able to exhibit.

4. The die casting method according to claim 1, wherein, when the plunger is once retracted, the plunger is hydraulically driven with a servo pump.

5. A die casting device comprising:

a plunger sleeve configured to be supplied with molten metal via a supply port;

dies that communicate with the plunger sleeve;

a plunger configured to inject the molten metal supplied to the plunger sleeve, into the dies; and a controller programmed to:

after the molten metal is supplied to the plunger sleeve, retract the plunger once; and after the plunger is once retracted, advance the plunger to inject the molten metal into the dies, and keep the plunger accelerated until the plunger reaches a target maximum speed when the retracted plunger is advanced.

6. The die casting device according to claim 5, further comprising a lid portion configured to open and close the supply port.

7. The die casting device according to claim 5, wherein, when the plunger is advanced, the controller is programmed to keep the plunger accelerated until the plunger reaches the target maximum speed, at a maximum acceleration which the die casting device is able to exhibit.

8. The die casting device according to claim 5, further comprising a servo pump configured to hydraulically drive the plunger, when the plunger is once retracted.

* * * * *